US008059383B2

(12) United States Patent
Post et al.

(10) Patent No.: US 8,059,383 B2
(45) Date of Patent: Nov. 15, 2011

(54) ELECTROSTATIC BLOWER SYSTEMS

(75) Inventors: Alvin Marion Post, Vancouver, WA (US); Bradley B. Branham, Vancouver, WA (US)

(73) Assignee: Hewlett-Packard Development Company, L.P., Houston, TX (US)

( * ) Notice: Subject to any disclaimer, the term of this patent is extended or adjusted under 35 U.S.C. 154(b) by 394 days.

(21) Appl. No.: 12/340,691

(22) Filed: Dec. 20, 2008

(65) Prior Publication Data

US 2010/0157504 A1 Jun. 24, 2010

(51) Int. Cl.
*H01T 23/00* (2006.01)
*H05F 3/00* (2006.01)
*H05F 3/04* (2006.01)

(52) U.S. Cl. ..... 361/230; 361/213; 361/231

(58) Field of Classification Search ..... 361/230, 361/231, 213

See application file for complete search history.

(56) References Cited

U.S. PATENT DOCUMENTS

| | | | | |
|---|---|---|---|---|
| 3,054,553 | A * | 9/1962 | White | 315/111.91 |
| 3,398,685 | A | 8/1968 | Stuetzer | |
| 3,794,111 | A * | 2/1974 | Blomgren et al. | 165/96 |
| 4,734,721 | A | 3/1988 | Boyer et al. | |
| 5,631,685 | A | 5/1997 | Gooray et al. | |
| 5,812,913 | A | 9/1998 | Morris et al. | |
| 5,999,769 | A | 12/1999 | Anderson et al. | |
| 6,418,289 | B1 | 7/2002 | Kleckner et al. | |
| 6,578,959 | B1 | 6/2003 | Seccombe | |

* cited by examiner

*Primary Examiner* — Jared Fureman
*Assistant Examiner* — Lucy Thomas

(57) ABSTRACT

Embodiments of electrostatic blower system for use in computer systems or other electronic device, e.g., in inkjet printers for cooling or drying operations, are disclosed. An exemplary method may include arranging a plurality of electrostatic blowers together to increase output pressure. The method may also include positioning the arranged electrostatic blowers directly adjacent a point of use in a printer device. The method may also include directing and accelerating airflow using a corona discharge in each of the plurality of electrostatic blowers for cooling or drying operations in the printer device.

20 Claims, 4 Drawing Sheets

ELECTROSTATIC BLOWER SYSTEMS

BACKGROUND

Blowers and fans find application in a wide variety of computer systems and other electronic devices. For example, blowers and fans may be implemented to help dissipate heat generated during operation of the computer system and other electronic devices. If not properly dissipated, heat generated during operation can shorten the life span of various electronic components and/or generally result in poor performance of the computers or other electronic devices. Various blowers are available, and when used for thermal management of computer systems and other electronic devices, these blowers are typically positioned to blow air across a heat sink and out an opening formed through the computer housing to dissipate heat into the surrounding environment.

Blowers and fans are also commonly used in ink jet printers to help dry the ink faster so that the pages can be laid down on top of one another or picked up by the user without smudging or smearing the ink on the paper.

Sizing the blower is important during development of these systems. However, developers also have to consider cost, size constraints, and acoustics (e.g., noise generated by the blower). In large rack-based computer systems, the number and/or size of fans needed to cool all of the components can make the room so noisy that technicians only enter the room on an as-needed basis (e.g., to make repairs, upgrades, etc.). Similarly, most consumers do not want to hear the noise created by a blower in their inkjet printer, which is usually located on or near their workspace.

DETAILED DESCRIPTION

Briefly, exemplary embodiments of electrostatic blowers disclosed herein may be used to dissipate heat in computers or other electronic devices, or as dryers in inkjet printers or the like. In an exemplary system, a plurality of electrostatic blowers may be configured in arrays. The blower array(s) may be located in computers or other electronic devices to remove hot air from the chassis to a physically remote environment (e.g., outdoors). The blower array(s) may also be located in inkjet printers to blow air onto the paper and dry the ink before duplexing (e.g., printing on the other side of the paper) or discharge of the paper from the inkjet printer.

During operation, the electrostatic blowers operate by charging or ionizing molecules in the air, typically with a corona discharge from a sharp corner or small diameter wire. Ions are then forcefully attracted to a ground plane, where the ions are mostly neutralized. As the ions travel to the grounded surface, the ions bump into uncharged air molecules, transferring kinetic energy, and generally pulling the rest of the air along through viscous drag.

Accordingly, the electrostatic blowers (or arrays of blowers) may decrease the costs associated with conventional fans, increases space available for components in the computer system or other electronic device, and improves acoustics during operation. In exemplary embodiments, the air flow may also be regulated and remotely controlled, if desired, to customize operation rate and/or readily upgraded to accommodate chances in conditions (e.g., operating temperature).

While the space savings (smaller size/volume) is advantageous, it is also noted that the electrostatic blowers or jets can be arranged in a configurable array, thereby serving as a distributed air-mover as opposed to a single unit from which air must be ducted. For example, if it is desirable to blow air onto a sheet of paper that's curved in an arc, the electrostatic blowers can be configured as a thin plate that fits against the curved path, with an array of small air-movers distributed over the entire plate. Thus, air can be provided very close to where the air is needed. The configurable geometry of the electrostatic blower arrays is radically different than that of a conventional air-mover and duct system.

Figure 1:
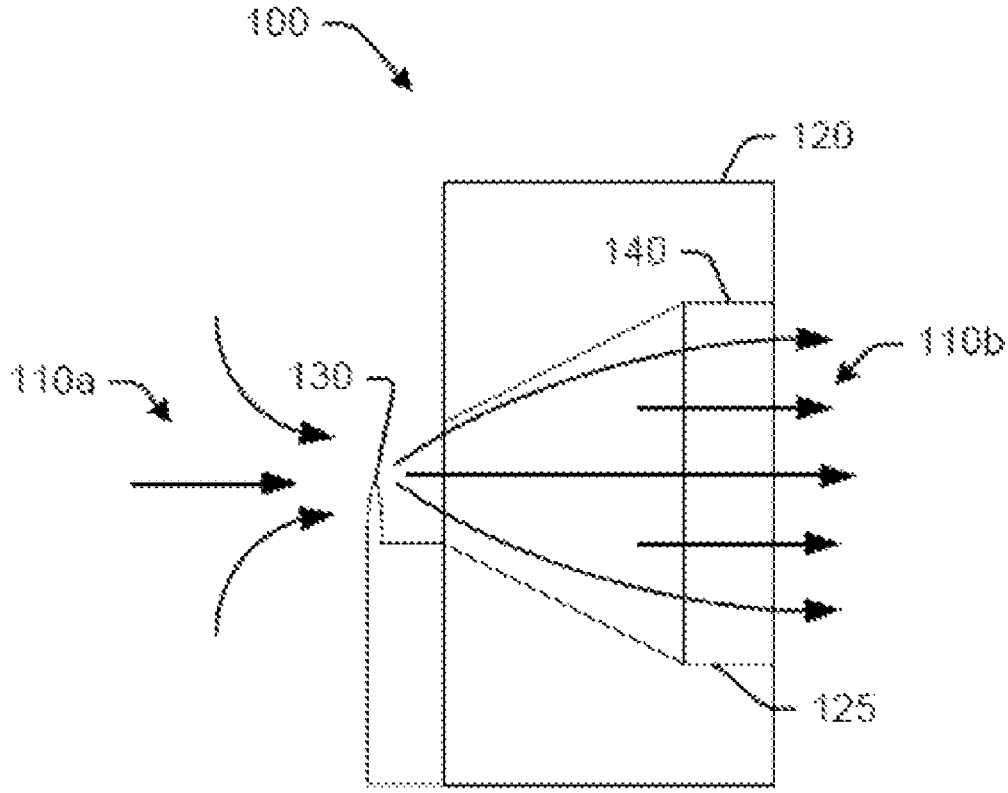
FIG. 1 is a cutaway side view of an exemplary electrostatic blower.

FIG. 1 is a cutaway side view of an exemplary electrostatic blower 100 for moving air as illustrated by arrows 110*a*, 110*b*. The electrostatic blower 100 may include a housing 120 having a channel 125 formed through at least a portion of the housing 120, and a corona discharge 130. The channel 125 and a ground plane 140 (e.g., a grounded metal ring) provided in or on the housing 120 directs airflow past the corona discharge 130, as illustrated by arrows 110*a*, 110*b*. Other geometries of the electrostatic blower may also be implemented, and this is only one example shown in FIG. 1.

Electrostatic blowers 100, also known as "ion drag" or "electrostatic pumps," are inexpensive, and can be made much smaller than conventional air movers or fans. Electrostatic blowers 100 are nominally as energy efficient as conventional air movers, and in some cases, even more efficient. Electrostatic blowers 100 have no moving parts, are truly silent, and can be made very small. Despite these advantages, electrostatic blowers historically have not been used in consumer products because of the cost and size of the power supplies required for computer systems and electronic devices. However, the recent availability of small, low-cost, solid-state power supplies, along with the configurations disclosed herein, makes electrostatic blowers 100 feasible for use in many computer systems and electronic devices, and in particular, in inkjet printers.

Use of electrostatic blowers 100 in computer systems and other electronic devices, such as inkjet printers, raises a variety of technical concerns. However, these can be comfortably managed with appropriate engineering design, and do not pose significant problems, as discussed in more detail below.

One such issue is high voltage safety. However, the high voltage is offset by exceedingly low currents (e.g., on the order of micro-amps), and with proper design, there are no unusual electrical safety hazards in such designs. In addition, the corona discharge points and high voltage surfaces can be positioned within the computer system or electronic device so as to be mostly, if not entirely, inaccessible to the everyday user. It should also be noted that most consumer computer systems and electronic devices (and other consumer products) also include areas of high voltage, without undue safety concerns if properly managed.

Another issue is the low output pressure of individual electrostatic blowers 100. However, the designs discussed herein include electrostatic blowers 100 which may be stacked in series or arranged in arrays (e.g., array 150 shown in FIG. 2) to increase the output pressure as necessary, within reasonable limits. It is also noted that a single electrostatic blower 100 can be manufactured to produce as much pressure as certain very small muffin fans. Slightly larger units may also be used to produce even more pressure.

Another issue is ozone production by the electrostatic blowers 100. However, careful design of the electrostatic blower 100 can significantly minimize ozone generation, and the ozone that is generated can be easily neutralized. For example, in small quantities, contacting the ozone that is generated with a suitable, inexpensive catalyst is sufficient to neutralize the ozone. Such effective surfaces can be incorporated in the design of the electrostatic blower 100 (or array 150), or positioned immediately adjacent the electrostatic blowers 100 (or array 150). Ozone may also be neutralized with activated charcoal air filters or by contact with catalysts.

Still another issue is the possibility of debris (e.g., paper dust in an inkjet printer) clogging the small blowers. But the incoming air can be readily filtered. Measured performance of an exemplary electrostatic blower 100 is shown in Table 1.

TABLE 1

Operating data of an exemplary electrostatic blower

| Operational Parameter | Measurement |
|---|---|
| Pressure (at nearly 0 flow) | 0.09 inches of water |
| Air Flow (at nearly 0 pressure or "free delivery") | 2 cubic inches per minute |
| Power consumption | 0.067 watts |
| Operating voltage | 14 Kilovolts (KV) direct current (DC) |
| Operating current (including parasitic losses) | 0.0000047 amps |

Although the performance data shown in Table 1 may appear at first glance to be only modest, it should be understood that the prototype of electrostatic blower 100 used to compile the data shown in Table 1 was crude and not optimized for design or component quality. Further optimization can be readily accomplished by those having ordinary skill in the art after becoming familiar with the teachings herein. Considerably better performance is expected using a well-engineered device. For example, home air cleaners implementing electrostatic blowers have been shown to move 50 cubic feet per minute (cfm) of air while consuming only 14 watts of power at 7 KV. Other electrostatic air movers have been shown to produce output on the order of 0.5 inches (water pressure).

It should also be recognized that the data in Table 1 was produced using an electrostatic blower 100 that is only 4 mm in largest dimension. Even given its size, the electrostatic blower 100 still produced enough air that, if used in the configurations described herein (e.g., as part of an array), is useful for a wide variety of applications, including applications in inkjet printers. Additional efficiencies may also be realized because such small units can be placed very close to the point of air usage. Such placement reduces pressure drops associated with ducting from larger conventional air movers, and heat losses from air heaters placed farther from the point of use. These and other configurations are discussed in more detail below with reference to FIG. 2.

Figure 2:
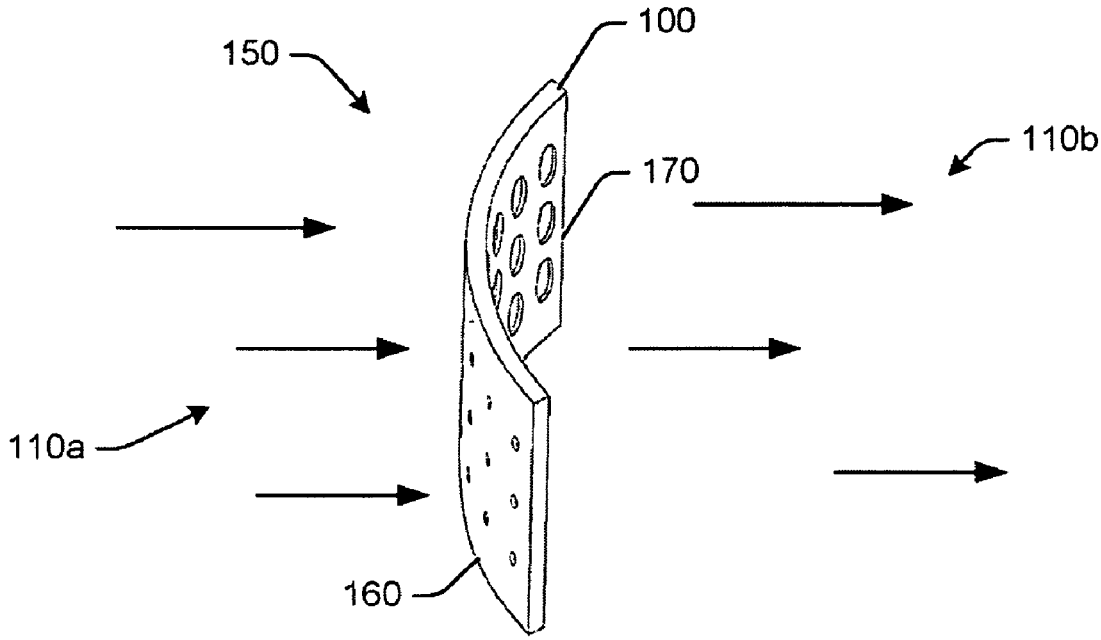
FIG. 2 is a perspective view of an exemplary blower array.

FIG. 2 is a perspective view of an exemplary blower array 150. The blower array 150 may include a thin plate 160 on which an array of miniature electrostatic blowers 100 are mounted. The thin plate 160 may be manufactured of a perforated plastic that in exemplary embodiments is configured to the shape required or even flexible. The electrostatic blowers 100 may be mounted within (or built into) the perforations. A metal ground plane 170 may be provided on one side. In an exemplary embodiment, the metal surfaces of the ground plane 170 may be vapor deposited or mechanically attached or otherwise assembled onto the plastic. The blower array 150 may be configured in any suitable geometry. In exemplary embodiments, the blower array 150 may be provided within the casing or housing of an electronics device in which the blower array 150 is being implemented. Indeed, the blower array 150 may even be used as part of a support structure.

In an exemplary embodiment, the blower array 150 includes a thin plate 160 measuring about 8.5×11 inches in size, and 4 mm thick. Such a configuration may contain 1500 (e.g., about 16 per sq inch, 4 mm in diameter each) single-stage blowers such one or more components of the electrostatic blower 100 shown in FIG. 1. Based on the data given above in Table 1, such a configuration produces approximately 2 cfm at free delivery. With refined blower design and proper variation in geometry and plate thickness, considerably more air flow 110*a*, 110*b* can be readily achieved.

Larger diameter blowers 100 may also be implemented to increase total air flow 110*a*, 110*b* for a similar thin plate 160 configuration, while also reducing viscous losses for the air flow 110*a*, 110*b*. Higher pressure may also be achieved with a thicker plate hosting multistage blowers. Power consumption may be equal to or less than that of conventional blowers.

Other modifications are also contemplated. For purposes of illustration, these configurations may include the electrostatic blowers 100 being stacked end to end to increase output pressure. In addition, the electrostatic blowers 100 shown in FIGS. 1 and 2 are round, with a needle point for corona discharge 130. But it is noted that the electrostatic blowers 100 can be made to have any suitable corona discharge, including, but not limited to long, narrow slots with a wire, razor blade edge, or series of sharp points. Further, the effectiveness of the electrostatic blower 100 can be enhanced by implementing a "repeller". A repeller may be provided as a small plate (not shown) placed upstream from the corona discharge 130, which is held at a slightly higher voltage than the corona discharge 130. The repeller tends to channel wayward ions in the desired direction.

The electrostatic blowers 100 (and arrays 150) described herein may be implemented in any of a wide variety of devices, including but not limited to computer systems and other electronic devices, such as inkjet printers. By way of example, the electrostatic blowers 100 may be incorporated into inkjet (or other type of) printers to dry the paper before duplexing or exiting. Electrostatic blowers 100 (or arrays 150) may be implemented in inkjet printers to operate at about 0.2 inches (water pressure) or as much as 25 cfm, using about 15 watts of power consumption based on the performance of known electrostatic blowers.

In an exemplary embodiment, heat may also be added immediately behind the thin plate 160, or by micro-heaters within each blower cell (e.g., the perforations shown in FIG. 2). The electrostatic blowers 100 (or arrays 150) may be positioned very close to the paper, thus minimizing thermal mass, time constants, and heat losses. It is further noted that heat could be provided by resistance, thermoelectric, or other heating sources.

As another illustration, the electrostatic blowers 100 (and arrays 150) described herein may also be used for cooling operations. Again, the electrostatic blowers 100 (or arrays 150) may be positioned near heat-generating components to provide both structural support and simultaneously circulating air for cooling.

In exemplary embodiments, the electrostatic blowers 100 (or arrays 150) may also be implemented for variable load conditions. For example, the output of one or more of the electrostatic blowers 100 (or arrays 150) may be varied by adjusting output and/or activating/deactivating the electrostatic blowers 100 (or arrays 150). Or for example, more than one electrostatic blower 100 (or array 150) may be implemented in series or parallel to handle varying loads. One or more controls may also be provided to control activation/deactivation and/or output.

Heat sensing device(s) may also be implemented to monitor the heat being generated. Remote actuators may be provided to control operation of the electrostatic blower 100 (or array 150) in response to feedback from the heat sensing device(s). During operation, firmware may operate the electrostatic blower 100 (or array 150) at different speeds, shut off one or more of the electrostatic blowers 100 (or arrays 150) when not needed, or vary other settings, to name only a few examples of operation.

For purposes of illustration, a single array 150 (or lower setting) may be sufficient to remove heat during light operation, and secondary arrays (not shown) may only be needed when the heat being generated exceeds a predetermined threshold. Such an implementation reduces energy use when more arrays (or higher operating speeds) are not needed, but if more heat is generated, the secondary arrays may be implemented to more quickly and effectively remove heat without adversely affecting operation.

Also in exemplary embodiments, one or more heat sink (not shown) may also be provided to aid in collecting heat and "wicking" the heat away from the heat-generating components and into the path of air flow generated by the electrostatic blowers (or arrays). Heat sinks are well understood in the art, and may be manufactured of a thermally conductive material (e.g., metal or metal alloys) configured to readily absorb heat in one area and dissipate the absorbed heat in another area. In an exemplary embodiment, the thermally conductive material is formed as a plurality of "fins," but other embodiments are also contemplated.

Figure 3:
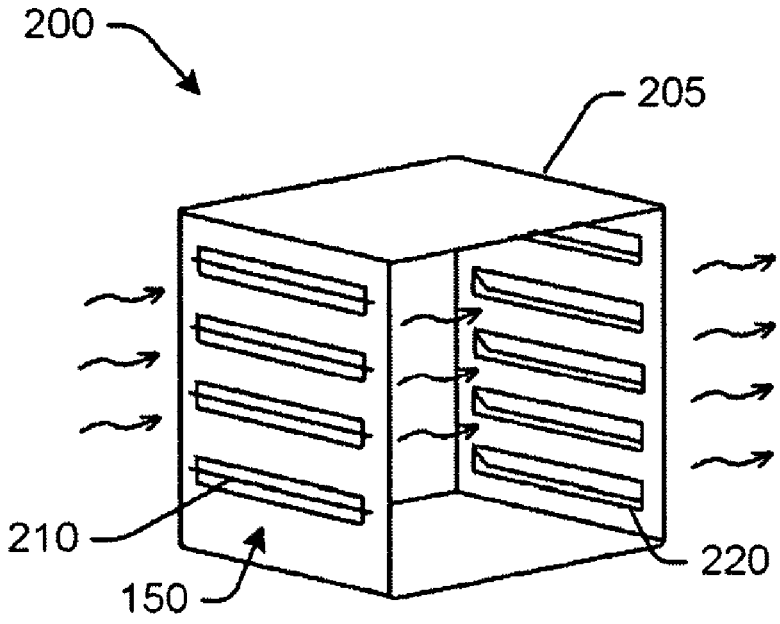
FIG. 3 is a perspective view of an exemplary electronics enclosure.
Figure 4:
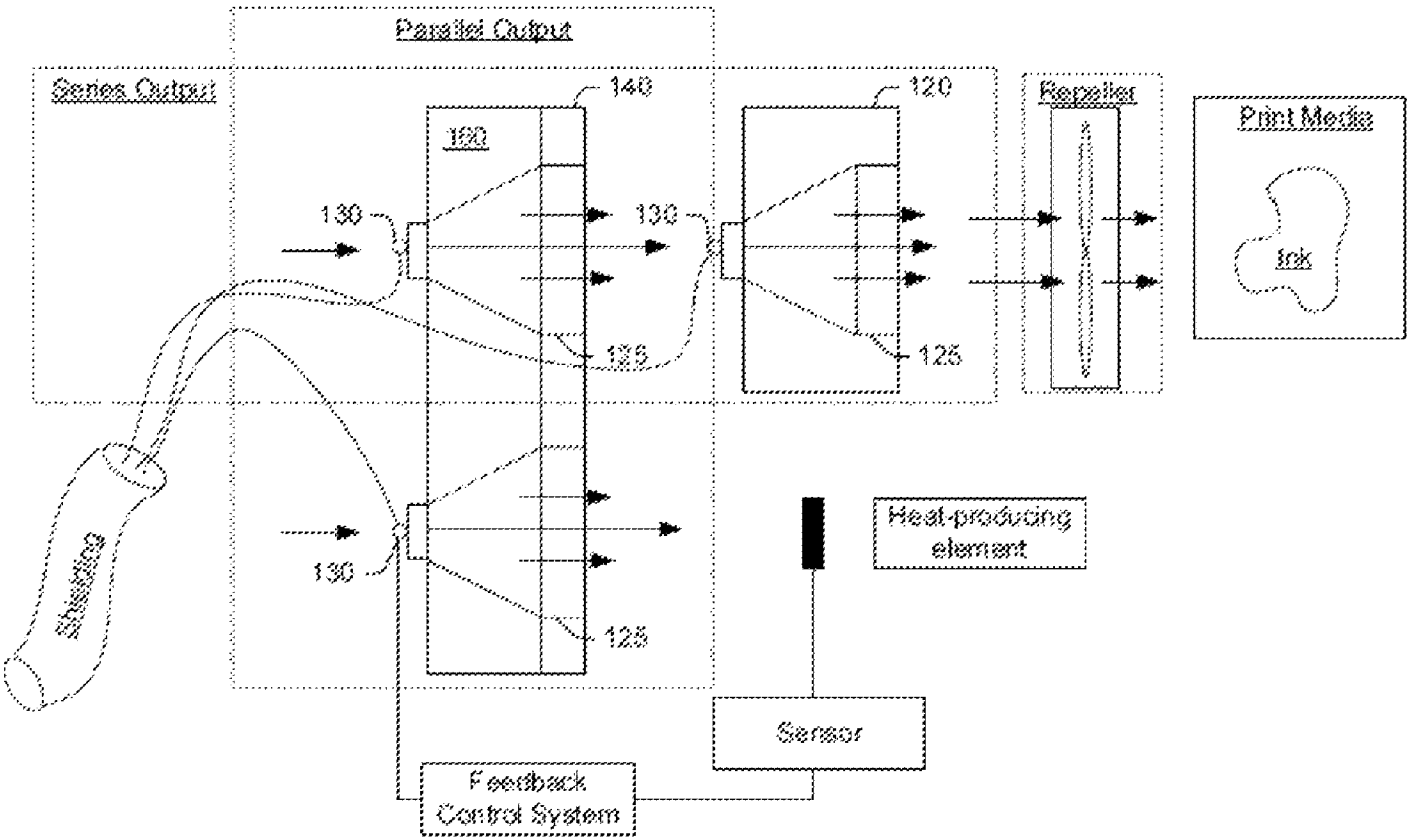
FIG. 4 is a schematic drawing of an example electrostatic blower system.

FIG. 3 is a perspective view of an exemplary electronics enclosure 200 implementing electrostatic blowers as arrays 150. The electronics enclosure includes the electrostatic blowers configured as a plurality of longitudinal arrays 150 with wire corona generators 210 on one side of housing 205, and exhaust louvers 220 on the opposite side of housing 205. It is noted that the electronics enclosure 200 is shown only as an example of one such configuration.

It is noted that the electrostatic blowers 100 and arrays 150 of electrostatic blowers 100 described herein offer a number of advantages. Such advantages include, but are not limited to, optimum use of space and the possibility of reducing product size, air delivery very close to the point of use; design flexibility; silent operation; lack of moving parts; potential cost savings; rapid switching between on/off states; reduced time constants for heating; and the opportunity to reduce overall device power requirements.

It is also noted that the use of positive pressure is implied in the above description. That is, the air blows on or past something from the outlets of the electrostatic blowers. However, the above description applies equally to the inlet air stream, which can be used to create a vacuum as well as positive pressure. For example, a heated electrical element could be placed on either side of the array and still be cooled.

It is further noted that although particular configurations and numbers of components have been described herein, any number of electrostatic blowers 100 (or arrays 150) may be implemented in any suitable configuration. The type and number of components and the configuration will depend on a variety of design characteristics, as will be readily appreciated by those having ordinary skill in the art after becoming familiar with the teachings herein.

It is also noted that the exemplary embodiments discussed above are provided for purposes of illustration. Still other embodiments are also contemplated. It is also noted that, although the systems and methods are described with reference to computer systems and inkjet printers, in other exemplary embodiments, the systems and methods may be implemented for other electronic devices, such as, peripheral devices for computers, video and audio equipment, etc.

In addition to the specific embodiments explicitly set forth herein, other aspects and embodiments will be apparent to those skilled in the art from consideration of the specification disclosed herein. It is intended that the specification and illustrated embodiments be considered as examples only.

The invention claimed is:

1. An electrostatic blower system, comprising: a plurality of electrostatic blowers configured together to increase output pressure for cooling or drying operations in an electronic device, the plurality of electrostatic blowers positioned on a flexible plate to operate in a parallel output configuration with one another, the plurality of electrostatic blowers each comprising:

a corona discharge for each of the plurality of electrostatic blowers;

a housing having a channel formed through at least a portion of the housing, the channel directing airflow past the corona discharge; and a ground plane provided in the housing to effect direction of the airflow past the corona discharge.

2. The system of claim 1, further comprising a repeller provided upstream from the corona discharge to enhance the airflow past the corona discharge.

3. The system of claim 1, wherein the corona discharge for each of the plurality of electrostatic blowers is attached to or part of a surface of the flexible plate, wherein the flexible plate is a thin metal sheet.

4. The system of claim 3, wherein the thin metal sheet is flexible for forming into a desired geometry, or rigid and pre-formed in the desired geometry, and the thin metal sheet is insulated from the ground plane.

5. The system of claim 1, further comprising at least one heat element positioned near or within a hole formed in the housing, the air flowing through the hole.

6. The system of claim 1, wherein the corona discharge is formed as at least one of a point, a plurality of points, and a line.

7. The system of claim 1, further comprising electrical shielding adjacent high voltage areas of the plurality of electrostatic blowers.

8. The system of claim 1, further comprising a metal ground plane on one side of the flexible plate, wherein the metal ground plane is the ground plane.

9. The system of claim 8, wherein the metal ground plane is vapor deposited onto a plastic surface, the vapor deposited metal ground plane on the plastic surface forming the flexible plate.

10. The system of claim 1, further comprising a plurality of single stage blowers configured as parallel output blowers.

11. The system of claim 1, wherein the plurality of electrostatic blowers comprise stacked single stage blowers positioned next to a plurality of stacked single stage blowers.

12. The system of claim 1, further comprising openings formed in the flexible plate, wherein the openings are the channel formed through at least a portion of the housing of each of the plurality of electrostatic blowers.

13. A method comprising:

arranging a plurality of electrostatic blowers together to increase output pressure, the plurality of electrostatic blowers arranged on a flexible plate to operate in a parallel output configuration with one another;

positioning the arranged electrostatic blowers directly adjacent a point of use in a printer device; and directing and accelerating airflow using a corona discharge in each of the plurality of electrostatic blowers for cooling or drying operations in the printer device.

14. The method of claim 13, wherein the arranged electrostatic blowers are positioned to minimize pressure losses and to deliver heated air close to an intended point of use for minimizing parasitic heat loss.

15. The method of claim 13, wherein the arranged electrostatic blowers are configured as an array.

16. The method of claim 13, wherein the arranged electrostatic blowers are formed on a configurable plate, the plate further operating as a support structure in the printer device.

17. The method of claim 13, further comprising adjusting air flow for at least one of changes in operating conditions, and changes in operating temperatures.

18. The method of claim 13, further comprising sensing temperature and adjusting air flow based on the sensed temperature.

19. An electrostatic blower array for use in inkjet printers, comprising:

a plurality of electrostatic blowers configured together to deliver output pressure for cooling or drying operations in an electronic device, the plurality of electrostatic blowers configured together on a flexible plate in a parallel output configuration with one another, the plurality of electrostatic blowers each comprising:

a corona discharge for each of the plurality of electrostatic blowers;

a housing having a channel formed through at least a portion of the housing, the channel directing airflow past the corona discharge; and a ground plane provided in the housing to effect direction of the airflow past the corona discharge.

20. The electrostatic blower array of claim 13, wherein the airflow is directed at least one of: over wet ink delivered by the inkjet printers to dry the wet ink prior to discharging a printed paper, and past heat-generating components of the inkjet printers.

* * * * *